United States Patent [19]

Saito

[11] 4,189,864

[45] Feb. 26, 1980

[54] SELF-POWERED TOY VEHICLE CHASSIS AND AUTOMATICALLY INTERCHANGEABLE BODIES

[75] Inventor: Makoto Saito, Tokyo, Japan

[73] Assignee: Tomy Kogyo Co., Inc., Tokyo, Japan

[21] Appl. No.: 857,233

[22] Filed: Dec. 5, 1977

[30] Foreign Application Priority Data

Dec. 6, 1976 [JP] Japan ..... 51-146803

[51] Int. Cl.[2] ..... A63H 19/00

[52] U.S. Cl. ..... 46/202; 46/216

[58] Field of Search ..... 46/201, 202, 216, 257, 46/258, 259, 260, 261

[56] References Cited

U.S. PATENT DOCUMENTS 4,645,908 9/1977 Ensmann et al. ..... 46/216

FOREIGN PATENT DOCUMENTS 1293300 10/1972 United Kingdom ..... 46/202

*Primary Examiner*—F. Barry Shay

*Attorney, Agent, or Firm*—Edward D. O'Brian

[57] ABSTRACT

A self-powered toy vehicle chassis adapted to removably receive a plurality of different types of bodies, such as a dump truck and a fork lift. A body receiving and dispensing support is provided which, when the toy vehicle chassis passes through carrying a removable body, lifts the body off the chassis and stores it in an overhead position and then enables the chassis to receive another previously stored overhead body and continue with this body thereon. If the direction of the vehicle chassis is reversed and again passed through the body receiving and dispensing support, the two bodies will again be interchanged on the chassis and such interchange of the two bodies will occur each time the toy vehicle chassis is reversed and passed through the body receiving and dispensing support.

3 Claims, 6 Drawing Figures

SELF-POWERED TOY VEHICLE CHASSIS AND AUTOMATICALLY INTERCHANGEABLE BODIES

BACKGROUND OF THE INVENTION

The present invention relates generally to toy vehicles, and more particularly, to a self-powered toy vehicle chassis which can automatically receive and reject a plurality of interchangeable bodies.

For many years self-powered vehicles such as electric trains and cars have been enjoyed by young children and many toys of this type include a continuous track or roadway layout on which the vehicle travels. To increase the play value of toys of this type, numerous accessories have been provided to add realism and action to such toys. For example, automatic coal, log, and baggage dumping and loading accessories are well known in the prior art for use in connection with electric train sets, and toys which comprise a track or roadway system on which a toy train or other self-propelled vehicle traverses through a pre-programmed series of forward and reverse maneuvers so as to simulate a train switching yard or a road construction site are all old and well known in the prior art.

One drawback to toys wherein a self-propelled vehicle traverses a pre-programmed series of operations on a track or guided roadway is that while there is an immediate attraction and fascination to toys of this type, after a short while children often become bored with the repetitive action of the toy, and the toy loses its play value.

While a number of self-powered toy vehicle sets have included a plurality of different types of vehicles to increase the play value of such sets, such provision by necessity increases the cost of such toys and often places them beyond the reach of many consumers.

SUMMARY OF THE INVENTION

It is the general aim of the present invention to provide a new and improved self-powered toy vehicle chassis which is capable of sequentially receiving and rejecting a plurality of different types of vehicle bodies so as to increase the functional capability of the toy and to also have increased play value.

It is another object of the invention to provide a toy vehicle chassis with a number of interchangeable bodies, each generally conforming to different pieces of self-powered heavy equipment utilized in the construction industry so as to serve an educational purpose by providing a child playing with such toy with an understanding of the operation and function of such full size heavy construction equipment.

Other objects and advantages of the invention will appear from the following description taken in conjunction with the accompanying drawings in which.

Figure 2:
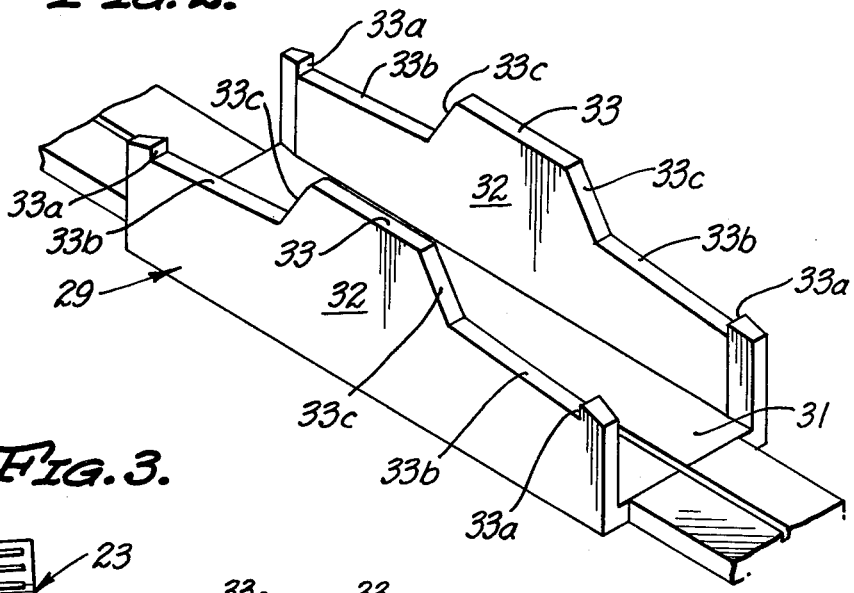
FIG. 2 is a perspective view of the vehicle body receiving and dispensing support used with the present invention.
Figure 4:
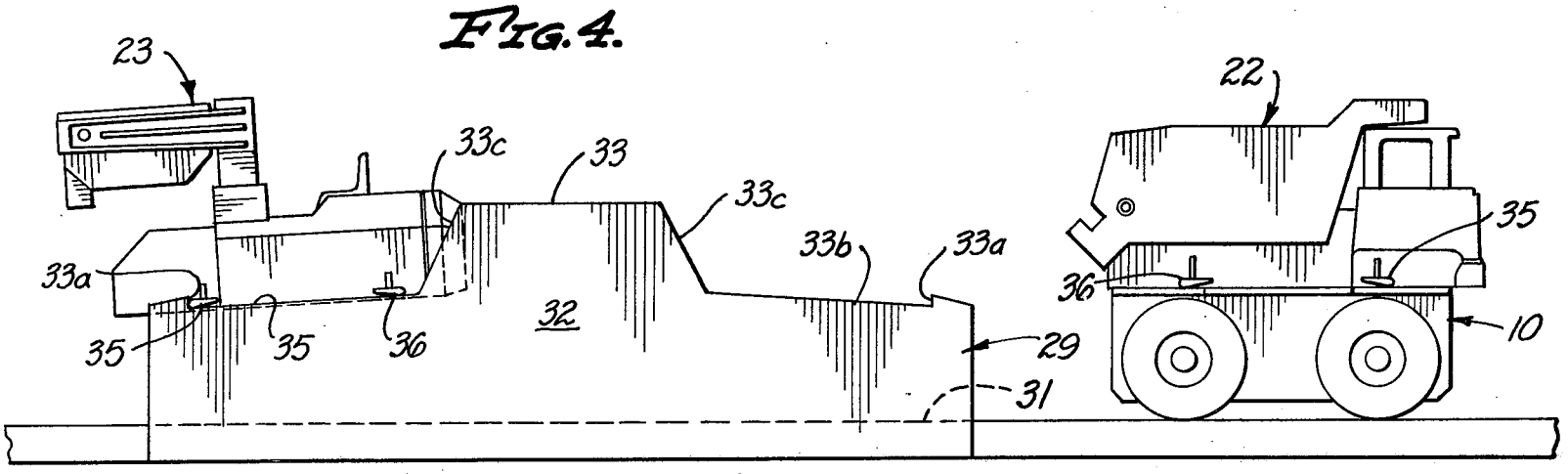
FIG. 4 is a side elevation of the vehicle body receiving and dispensing support shown in FIG. 2 with one vehicle body in its stored position and the self-powered vehicle chassis carrying another removable vehicle body and entering the support from a right to left direction.
Figure 5:
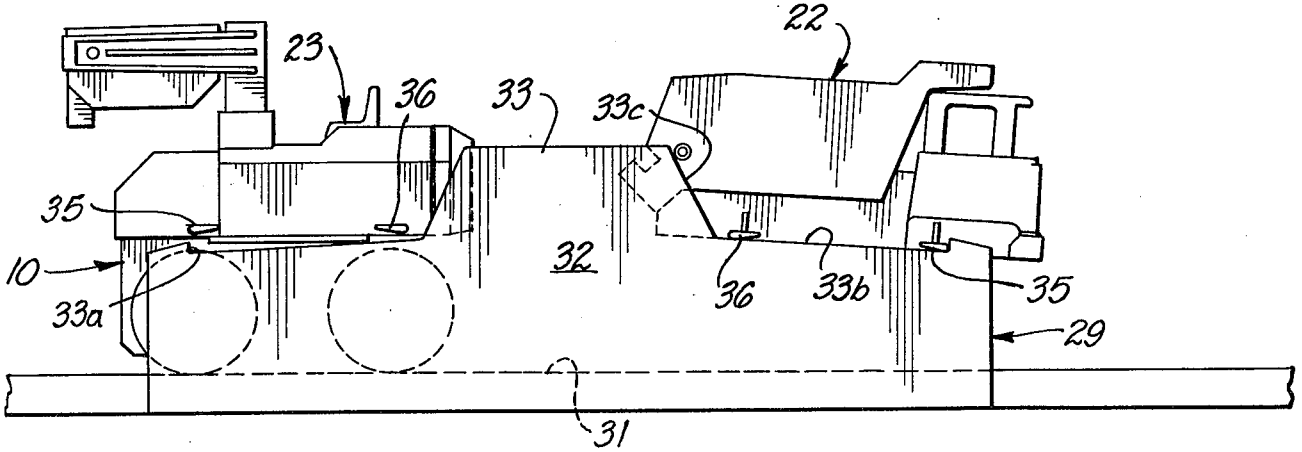
Figure 6:
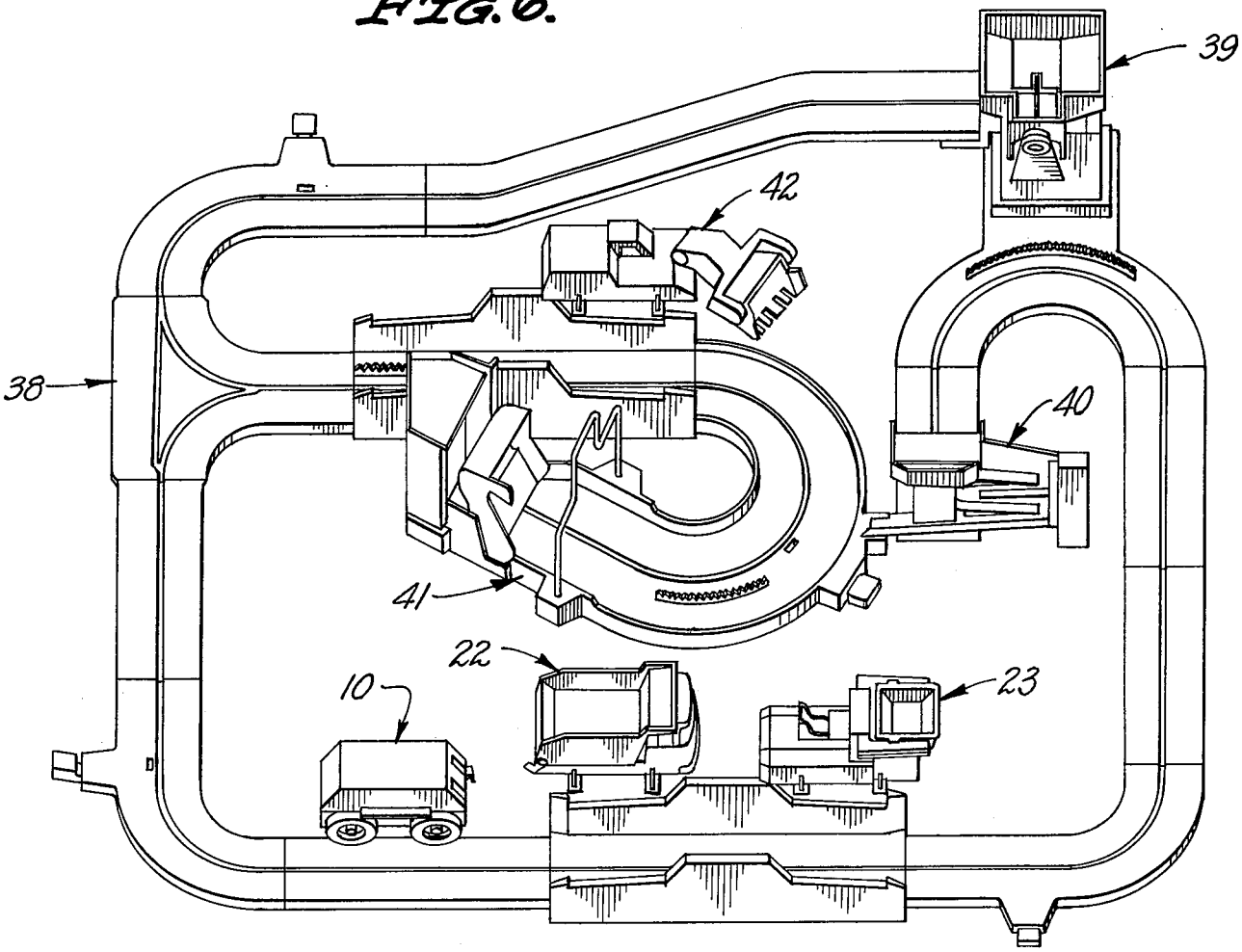

FIG. 5 is a side elevation of the vehicle body receiving and dispensing support shown in FIG. 2 depicting the relationship of the two vehicle bodies and the vehicle chassis after the chassis shown entering the support in FIG. 4 has passed partially through the support in a right to left direction depositing the first body into a storage position on the support and receiving the previously stored body; and FIG. 6 is a perspective view of the present invention illustrated as part of a complete self-powered vehicle, track layout, and accessory system.

While the present invention is susceptible of various modifications and alternative constructions, illustrative embodiments are shown in the drawings and will herein be described in detail. It should be understood, however, that it is not contended to limit the invention to the particular forms disclosed, but, on the contrary, intention is to cover all modifications, equivalents, and alternative constructions falling within the spirit and scope of the invention as expressed in the appended claims.

DETAILED DESCRIPTION OF THE PREFERRED EMBODIMENT

Figure 1:
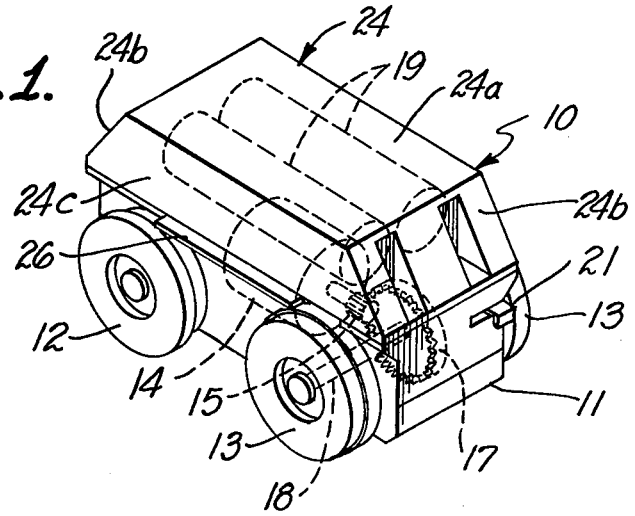
FIG. 1 is a perspective view of the self-powered toy vehicle chassis used with the present invention.

Referring now to FIG. 1, an exemplary self-powered toy vehicle chassis, generally indicated at 10, is illustrated, the chassis including a motor and drive train housing 11, a pair of wheels 12, and a pair of wheels 13. As depicted in broken lines in FIG. 1, the chassis in the illustrated embodiment is powered by a small electric motor 14 having a small gear 15 on its output shaft which in turn engages a larger gear 17 which is carried on axle 18 through which the pair of wheels 13 are attached. To power the motor, batteries 19 of the conventional dry cell or rechargeable type are mounted within the chassis 10 and are wired to the motor 14 through an on-off switch 21. While not illustrated, it is well known in the art for a small self-powered electric vehicle operating on a track or roadway to derive its power through electrical contacts on the track or roadway and such an arrangement could be readily utilized with the instant invention instead of batteries should a track or roadway be utilized with the instant invention.

In accordance with one of the important aspects of the present invention, provision is made for the chassis 10 to be able to receive a plurality of interchangeable toy vehicle bodies which can also be readily removed from the chassis as hereinafter described. Referring collectively to FIGS. 2 through 5, two such removable bodies are shown—a dump truck body generally indicated at 22 and a fork lift body generally indicated at 23. The interchangeability of dump truck body 22 and fork lift body 23 on chassis 10 is accomplished by providing the upper portion 24 of the chassis 10 with a trapezoidial cross-section having a top surface 24*a*, end surfaces 24*b*, and side surfaces 24*c*, and having a horizontal vehicle body supporting ledge 26 underlying each side surface 24*c* of the upper portion of the chassis. As shown in dotted lines in FIG. 3, the bottom of both the dump truck body 22 and fork lift body 23 is provided with a recess 27 having a trapezoidial cross-section which conforms to the upper portion 24 of the chassis so that either the dump truck body 22 or fork lift body 23 can be readily received by the chassis 10 with the lowermost portion of either body resting on the vehicle body supporting ledge 26 of the chassis as shown in FIG. 4.

In accordance with another important aspect of the present invention, provision is made for the automatic sequential removal of one vehicle body from the chassis and the other vehicle body being placed on the chassis. To accomplish this, a vehicle body receiving and dispensing support generally indicated at 29 is provided, the support including a horizontal base 31 which defines the rolling surface or pathway for the chassis 10, and a pair of vertical spaced parallel side walls 32 at each side of the base 31 with each side wall of the pair 32 having the same upper configuration 33 which is generally symmetrical about the center of each side wall, and including a stop abutment 33*a*, a gently inclined surface 33*b* beginning at the rear of each abutment 33*a*, and rising toward the center of the side wall where it intersects a sharply rising inclined surface 33*c* which rises toward the center of the side wall as shown. As shown in FIGS. 2, 3, 4 and 5, the length of each side wall conforms generally to the length of two vehicle bodies with the length of inclined surface 33*b* conforming to a substantial portion of the length of a vehicle body.

In order to accomplish the removal of a vehicle body from the chassis 10 or the placement of a vehicle body on the chassis 10 in accordance with the objects of the present invention, each of the vehicle bodies 22 and 23 are provided on each side with a pair of front support tabs 35 and a pair of rear support tabs 36 which in turn are adapted to engage the upper surface 33 of the pair of side walls 32 as shown in FIGS. 2 through 5, and as particularly depicted in FIG. 2, tabs 35 and 36 are spaced a distance apart generally conforming to the length of upper surface 33*b* so that tabs 35 and 36 can support the vehicle on surface 33*b* as shown in FIG. 2.

Figure 3:
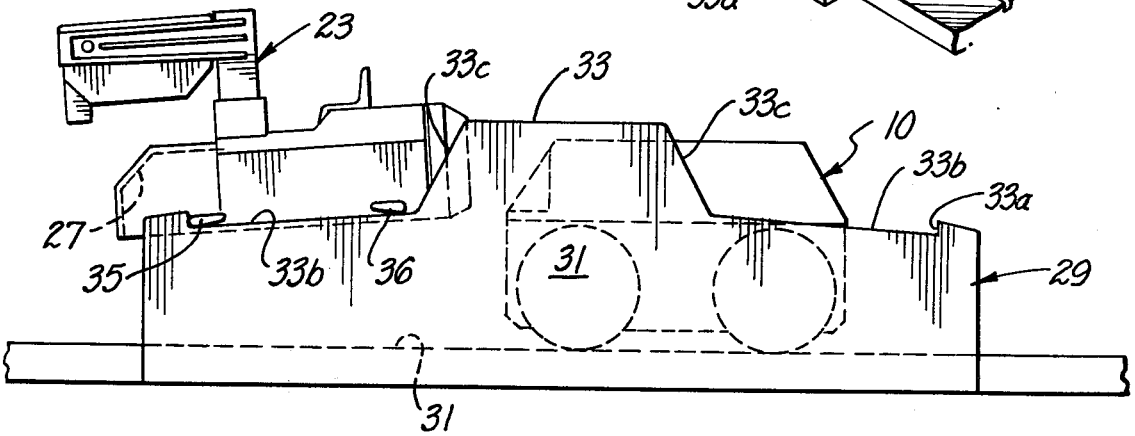
FIG. 3 is a side elevation of the vehicle body receiving and dispensing support shown in FIG. 2 with a vehicle body in its stored position and the self-powered vehicle chassis passing through the support from right to left.

As shown in FIG. 3, the automatic placement of vehicle body 23 onto chassis 10 is accomplished when chassis 10 passes through the vehicle body receiving and dispensing support 29 in a right to left direction with the vehicle body 23 resting on surface 33*b* of the side walls 32 by virtue of the engagement of its support tabs 35 and 36 on said surface. Still referring to FIG. 3, it will be readily apparent that when the forward end surface 24*b* of the upper portion of the chassis impacts the rear of the forklift body 23, the lower rearward edge 25 of the forklift body will ride up on the forward end surface 24*b* since the front support tabs 35 of the forklift body 23 are in contact with abutment 33*a* preventing the forward movement of the forklift body 23 when it is first impacted from the rear by the moving chassis 10. It can readily been seen by referring to FIGS. 3 and 5, that once the lower rear edge of the forklift body 23 rides up on the surface 24*b* of the chassis, the chassis will continue to move forward in a right to left direction with the lower rear edge of the forklift body 23 sliding along the upper surface 24*a* of the chassis until it reaches the rearward sloping end surface 24*b* of the chassis at which time the forklift body will drop down into a mating relationship with the chassis with the front and rear support tabs 35 and 36 being at an elevation higher than the stop abutments 33*a* enabling the chassis, while carrying forklift body 23, to continue in an integral forward movement as shown in FIG. 5.

To accomplish the removal of a vehicle body from the chassis, it will be seen with reference to FIGS. 4 and 5 that when the chassis 10 enters the vehicle body receiving and dispensing support 29 from a right to left direction carrying the dump truck body 22 in a rearward direction, the rear support tabs 36 of the dump truck body will, as the chassis 10 enters the support 29, pass over the forward stop abutment 33*a* and engage the sharply inclined surface 33*c* which will prevent the dump truck body 22 from continuing with the moving chassis and will in turn also lift the body upwardly thereby enabling the chassis to move out from under the body 22 and once the chassis passes, the vehicle body 22 will slide back down to a stored position as shown in FIGS. 2 and 5.

From the above description and with reference to FIGS. 4 and 5, it will be seen that when chassis 10 makes one pass through the vehicle body receiving and dispensing support 29 in a right to left direction, it will deposit the previously mounted dump truck body 22 and receive the forklift body 23. Due to the symmetrical configuration of each side wall of the pair 32, it will be further readily apparent that if, after passing through the support as just described, the chassis now carrying the forklift body 23 is reversed and again passed through the support 29 in a left to right direction, it will deposit the forklift body 23 and pick up the dump truck body 22 and emerge from the right side of the support carrying the dump truck body 22 in a forward direction. From the above description it will be readily apparent that the automatic interchangeable vehicle bodies of the instant invention can find many applications in play situations and as part of an overall toy vehicle system or layout. An example of such a layout and system is shown in FIG. 6 which includes a track layout 38, a material dispenser 39, a material receiving chute 40 and a vehicle loading station 41 with still another interchangeable body 42 of the steam shovel type. While a detailed explanation of the operation of these various accessories is not required for an understanding of the instant invention, it will be readily appreciated by those skilled in the art that literally endless numbers of permutations and combinations of accessories and interchangeable vehicle bodies could be provided to create exciting and imaginative type situations.

It will also be readily apparent that the instant invention could be utilized without a self-powered chassis whereby the child would manually roll the chassis 10 through the vehicle body receiving and dispensing support 29 to accomplish the interchange of the vehicle bodies.

I claim as my invention:

1. A wheeled vehicle toy comprising:

a chassis having a plurality of rollable wheels mounted thereon and at least one vehicle body adapted to be removably received by said chassis, and vehicle body receiving and dispensing means whereby when said chassis rolls through said receiving and dispensing means with one of said vehicle bodies thereon, said vehicle body will be removed from the chassis without materially impeding the movement of the chassis, and wherein said vehicle body receiving and dispensing means comprises a vehicle body support having a generally horizontal base portion defining a roadway for said wheeled chassis and a pair of spaced, generally vertical parallel mutually similarly shaped side walls with upper surfaces, at least a portion of each said upper surface thereof being relatively sharply inclined forwardly and upwardly relative to the direction of approach of said chassis to said vehicle body support and said vehicle body including a plurality of projection means extending therefrom and adapted to operatively engage that portion of the upper portion of said side walls defining said incline whereby when said chassis carrying one of said vehicle bodies passes through said vehicle body support, said projection means will engage said inclined portion of the upper surface of said side walls thereby lifting said body off said chassis and into an overhead storage position.

2. The wheeled vehicle toy as set forth in claim 1 wherein:

each end of the upper portion of said chassis is inclined upwardly toward the center of said chassis whereby when said chassis passes through said vehicle body support without a vehicle body thereon, and with said support having a vehicle body stored overhead, the upwardly inclined forward end of the upper portion of said chassis will engage one end of said stored vehicle body lifting said end upwardly over and onto said chassis without materially impeding the movement of the chassis.

3. The wheeled vehicle toy as set forth in claim 2 wherein:

said vehicle body support has a first portion to receive a vehicle body carried by a chassis passing through said support and a second portion for placing a vehicle body stored on said support onto a chassis passing through said support whereby when said chassis enters said vehicle body support with one of said vehicle bodies thereon and with said support having one of said vehicle bodies stored thereon, the vehicle body being carried by the chassis will be removed and placed in storage on said vehicle body support and the vehicle body theretofore stored on said vehicle body support will be placed on said chassis, with said chassis exiting said vehicle body support with the previously stored body thereon.

* * * * *